US005484358A

United States Patent [19]

Wang et al.

[11] Patent Number: 5,484,358

[45] Date of Patent: Jan. 16, 1996

[54] AUTOMATIC MAGNETIC CONTROLLER FOR MAGNETIC TENSION BY SETTING WATTAGE

[75] Inventors: Leao Wang; Peter Wu, both of Taichung, Taiwan

[73] Assignee: Greenmaster Industrial Corp., Taichung, Taiwan

[21] Appl. No.: 274,422

[22] Filed: Jul. 13, 1994

[51] Int. Cl.[6] ..... A63B 69/00

[52] U.S. Cl. ..... 482/9; 482/1; 482/2; 482/4; 482/5; 482/6; 482/8; 482/901; 482/903

[58] Field of Search ..... 482/1–9, 900–903, 482/63–65, 57; 364/410, 411, 511

[56] References Cited

U.S. PATENT DOCUMENTS

| | | | |
|---|---|---|---|
| 5,027,303 | 6/1991 | Witte | 364/511 |
| 5,094,447 | 3/1992 | Wang | 482/63 |
| 5,165,278 | 11/1992 | Huszczuk et al. | 482/900 X |
| 5,254,061 | 10/1993 | Leask | 482/63 |
| 5,256,115 | 10/1993 | Scholder | 482/63 X |
| 5,310,392 | 5/1994 | Lo | 482/63 |

*Primary Examiner*—Richard J. Apley
*Assistant Examiner*—Glenn E. Richman
*Attorney, Agent, or Firm*—Beveridge, DeGrandi, Weilacher & Young

[57] ABSTRACT

An automatic magnetic controller is linked with a computer to process a formula for the relationship between the wattage and the expended calories. Then the desired numbered of calories will be accurately exhausted based on a relative arrangement between a magnetic member and a flywheel by means of a motor controller and a position controller. By this arrangement, the tension can be accurately calculated based on the rotations per minute of the flywheel. The tension is continuously arranged and adjusted to make the wattage remain at a constant value. Additionally, the number of calories remaining to be exhausted is displayed on the computer. In this manner, the exhausted calories can be accurately controlled. The magnetic controller controls the tension on the flywheel such that at high flywheel speeds, the tension is smaller, and on the contrary, the lower the flywheel speed, the higher the tension.

4 Claims, 2 Drawing Sheets

AUTOMATIC MAGNETIC CONTROLLER FOR MAGNETIC TENSION BY SETTING WATTAGE

BACKGROUND OF THE INVENTION

This invention relates to an automatic magnetic controller for magnetic tension by setting wattage. The distance between a flywheel and magnetic members is accurately adjusted and moved by a motor controller and a positioning controller which receive the mandate issued from a micro computer. Accordingly, the tension is accurately set to conform to the desired wattage for the user.

Sporting equipment used indoors has been widely used as the main auxiliary equipment for reducing the redundant weight or recovery of a patient. During the treatment, the physician or nourishist will require the patient to participate in a predetermined sport through the use of sporting equipment. When the load on the sporting equipment is set to a desired wattage, then after a certain period of exercise, not only will the body be warmed, but also alot of calories will be exhausted after the exercise is completed.

In conventional sporting equipment incorporated with a magnetic controller, the controlling flow charts for the circuitry of the tension controller is disclosed in FIG. 1. Before the user begins exercising, the tension can be set from the computer 10. Then the computer 10 will compute such values and actuate the motor 12 and stud 13 by means of the motor controller 11. By the arrangement, the magnetic member 15 which is installed at the other side of the slide 14 is moved close to or away from the flywheel 16. The magnetic member 15 is positioned through the sensor 17 and the positioning controller 18. By this arrangement, a certain amount of tension is set. Then the user may commence his exercise at the preset wattage. But during the exercise, the display of the computer only displays the milage and the time, no wattage and exhausted calories are shown in the display.

For example, the nourishist may require that the patient take a sport based on 120 wattage and one (1) hour to exhaust about seventeen (17) Kcal. When the patient completes this exercise after one (1) hour, the exhausted calories can be calculated by referring to the milage. But in fact, the calories exhausted can only be accurately calculated by using a wattage factor. On the other hand, the wattage has a close relationship with the rotations per minute (RPM) and the applied force. If the RPM and the applied force do not remain constant values, the wattage will be inaccurate. As a result, the data gained therefrom will shift away from the real situation. Not only will an exercise deficiency or surplus exist, the result of the treatment will be badly effected.

SUMMARY OF THE INVENTION

It is an object of this invention to provide an automatic magnetic controller where a computer is incorporated to process the formula for the relationship between the wattage and the calories. Then, the desired calories to be exhausted will be accurately transformed into the correlation between the magnetic member and the flywheel by means of the motor controller and the position controller. By this arrangement, the tension can be accurately calculated despite the rotations per minute of the flywheel. The tension is continuously arranged to make the wattage remain at a constant value. In this manner, the calories now exhausted are accurately displayed on the computer. Accordingly, the exhausted calories can be accurately controlled.

BRIEF DESCRIPTION OF THE DRAWINGS

The structural and operational characteristics of the present invention and its advantages as compared to the known state of the prior art will be better understood from the following description, in conjunction with the attached drawings which show illustratively, but not restrictively, an example of an automatic magnetic controller for magnetic tension by setting wattage. In the drawings.

DETAILED DESCRIPTION OF THE PREFERRED EMBODIMENT

Figure 1:
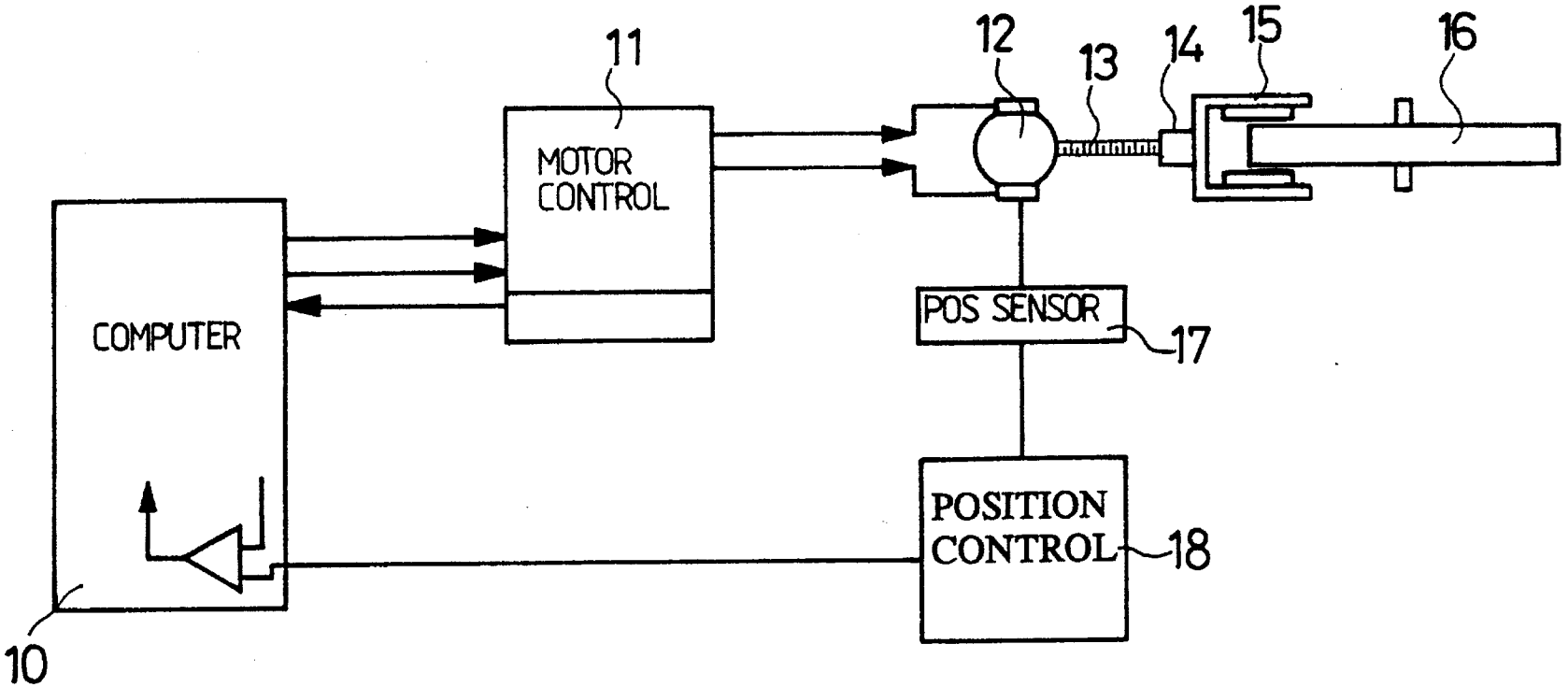
FIG.1 PRIOR ART
FIG. 1 is a flow chart for operation of a controller used in conventional sporting equipment.
Figure 2:
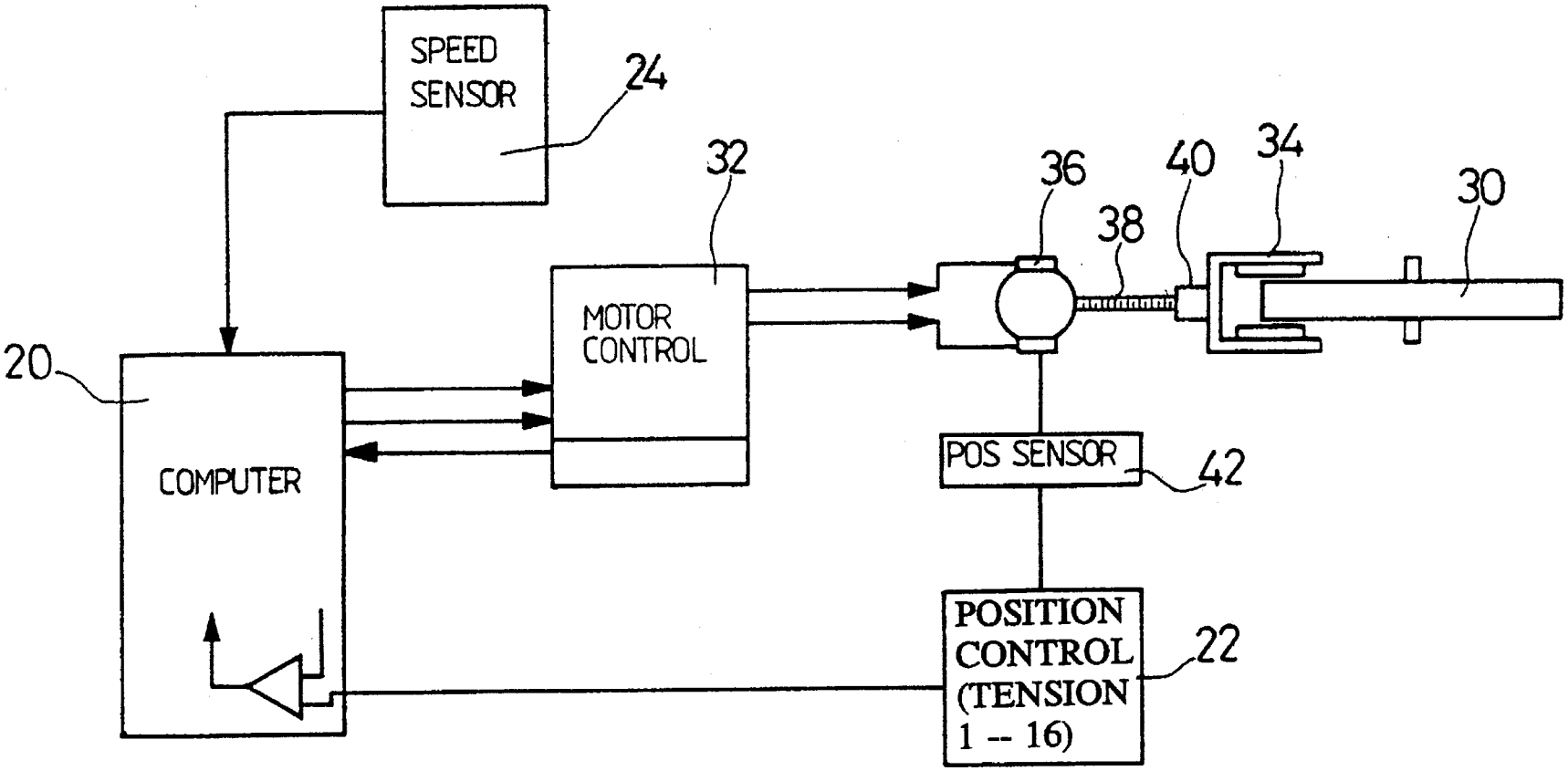
FIG. 2 is a flow chart for the magnetic controller made according to the present invention.

Referring to FIG. 2, the positioning controller 22 is calibrated into sixteen (16) divisions for applying different tension. The positioning controller 22 is electrically connected to the computer 20. The computer 20 is also connected with a speed sensor 24 installed at the flywheel 30. A preset formula for the correlation between the wattage and the calories is built in the computer 20. By this arrangement, the wattage and the calories to be exhausted can be set through the computer. Then, the user can commence his/her exercise. When the computer 20 receives the signal of the rotations per minute (RPM) of the flywheel 30 through the sensor 24, a mandate will be issued to the motor controller 32 to arrange the distance between the magnetic member 34 and the flywheel 30. Accordingly, an adequate amount of tension is set, and consequently, the wattage to be reached is achieved. In addition, the calories are calculated based on a decreasing manner, such that the remaining calories to be exhausted are shown on the computer 20. In operation of the device, the lower the RPM of the flywheel 30, the closer the distance between the magnetic member 34 and the flywheel 30, and the larger the tension. Accordingly, the higher the speed of the flywheel 30, the longer the distance between the magnetic member 34 and the flywheel 30, and the smaller the tension. By this arrangement, regardless of the speed of the flywheel, the tension remains constant, and the wattage remains constant.

In the preferred embodiment, the tension for the magnetic member 34 is calibrated into sixteen (16) divisions to adjust the distance between the magnetic member 34 and the flywheel 30. Location of the magnetic member 34 within these divisions is accurately adjusted by the positioning controller 22 which receives the mandate from the computer 20. The closer the distance between the magnetic member 34 and the flywheel 30, the larger the magnetic force therebetween. If the rotation of the flywheel 30 is lowered when the user becomes tired, then a signal will be sent to the computer 20 from the sensor 24, the motor controller 32 will actuate a mandate to move the motor 36 and the stud 38, and then the magnetic member 34 installed at the other side of the slider 40 is moved closer to the flywheel 30 to increase the tension. The positioning controller 22 will accurately control the distance between the magnetic member 34 and the flywheel 30. As the tension increases, the load to the user increases as well, and accordingly, the wattage still remains at a constant value.

The following is a description of the formula used to calculate the wattage. In this embodiment, the flywheel has a diameter of twenty-six (26) inches.

$$WATT=(1+(Tension-1)*0.222)*0.0179*RPM*RPM$$

Wherein:

Tension: Magnetic retarding force which is calibrated into sixteen (16) divisions.

The coefficient 0.222 and the coefficient 0.0179 are accurately derived from the frame of the sporting equipment and other conditions. These two coefficients vary, depending on the type of sporting equipment and is not the subject matter of the present invention.

For example, if the user hopes to exercise at 140 wattage with a rotation of the flywheel kept at eighty (80) RPM, then the derivation from the formula is as follows:

$$140=(1+(\text{Tension}-1)*0.222)*0.0179*80*80$$

$$140=(1+(0.222\ \text{Tension}-0.222))*114.56$$

Now take the (1+(0.222 Tension–0.222)) as an X parameter, and:

$$140=X*114.56$$

$$X=1.222$$

that is:

$$1.222=(1+(0.222\ \text{Tension}-0.222))$$

$$1.222=0.222\ \text{Tension}-0.222+1$$

$$1.222=0.222\ \text{Tension}+0.778$$

$$1.222-0.778=0.222\ \text{Tension}$$

$$0.444=0.222\ \text{Tension};$$

and thus:

Tension=2

When the computer 20 receives that data, the motor controller 32 will actuate the motor 36 and the stud 38 to move the magnetic member 34 to the two (2) division. This position will be ensured and confirmed by the sensor 42 and the positioning controller 22. Afterward, if the rotation of the flywheel is lowered down to sixty-one (61) RPM, then the calculation is:

$$140=(1+\text{Tension}-1)*0.222)*0.0179*61*61$$

$$140=(1+(0.222\ \text{Tension}-0.222))*66.6$$

Now take the (1+(0.222 Tension–0.222)) as the X parameter, and:

$$140=X*66.6$$

$$X=2.1$$

that is:

$$2.1=(1+(0.222\ \text{Tension}-0.222))$$

$$2.1=0.222\ \text{Tension}-0.222+1$$

$$2.1=0.222\ \text{Tension}+0.778$$

$$2.1-0.778=0.222\ \text{Tension}$$

$$1.332=0.222\ \text{Tension};$$

and thus:

Tension=5.995=6

When the computer 20 receives that data, the motor controller 32 will actuate the motor 36 and the stud 38 to move the magnetic member 34 to the six (6) division. Then the wattage of 140 still remains even though the rotation is lowered. If the rotation increases, the wattage of 140 can still be maintained.

By this arrangement, the user can concentrate on his exercise without care about the display for the RPM or Wattage or the calories exhausted. Only a decreasing number of calories will be displayed on the computer 20. The tension can be accurately calculated by the computer in accordance with the RPM, and accordingly, the preset wattage is set continuously.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. An automatic magnetic controller for magnetic tension comprising:

a flywheel;

a magnetic member located proximate said flywheel;

a computer;

a positioning controller which is calibrated into sixteen divisions for adjusting tension applied to the flywheel by the magnetic member, said positioning controller being electrically connected to said computer; and a sensor installed at the flywheel and connected with said computer, wherein the sensor senses a number of rotations per minute of the flywheel and sends a signal to said computer indicative of the number of rotations per minute, wherein a formula for the correlation between wattage and calories is included in said computer, such that the wattage and the calories to be exhausted are set through said computer, and while a user is exercising, the computer receives the signal from said sensor, and the computer sends a signal to adjust a distance between said magnetic member and said flywheel, so as to regulate the tension and maintain the wattage at a constant value.

2. An automatic magnetic controller for controlling magnetic tension, comprising:

a flywheel;

a magnetic member located proximate the flywheel;

a computer;

a controller for adjusting tension applied to the flywheel by the magnetic member, the controller being electrically connected to the computer; and a sensor installed at the flywheel and connected with the computer, wherein the sensor senses a number of rotations per minute of the flywheel and sends a signal to the computer indicative of the number of rotations per minute, wherein a formula indicative of a correlation between wattage and calories is included in the computer, wherein the wattage and the calories to be exhausted are set through the computer, and while a user is exercising, the computer receives the signal from the sensor, and the computer sends a signal to adjust a distance between the magnetic member and the flywheel, so as to regulate the tension and to maintain the wattage at a desired value.

3. An automatic magnetic controller according to claim 2, wherein the controller adjusts the tension applied to the flywheel by arranging the magnetic member at one of a plurality of positions based on the number of revolutions per minute of the flywheel.

4. An automatic magnetic controller according to claim 3, wherein the controller arranges the magnetic member to one of sixteen different positions.

* * * * *